US008911181B1

(12) United States Patent
Dosdourian

(10) Patent No.: US 8,911,181 B1
(45) Date of Patent: Dec. 16, 2014

(54) SOIL STABILIZATION METHOD AND APPARATUS

(71) Applicant: Fixdirt, LLC, Palm Beach Gardens, FL (US)

(72) Inventor: Samuel S. Dosdourian, Palm Beach Gardens, FL (US)

(73) Assignee: FixDirt, LLC, Palm Beach Gardens, FL (US)

( * ) Notice: Subject to any disclaimer, the term of this patent is extended or adjusted under 35 U.S.C. 154(b) by 0 days.

(21) Appl. No.: 14/181,251

(22) Filed: Feb. 14, 2014

Related U.S. Application Data

(60) Provisional application No. 61/765,478, filed on Feb. 15, 2013.

(51) Int. Cl.
*E02D 3/12* (2006.01)
*C09K 17/12* (2006.01)

(52) U.S. Cl.
CPC ..... *E02D 3/12* (2013.01)
USPC ..... 405/266; 405/269; 405/302.4

(58) Field of Classification Search
USPC ..... 405/263, 266–269, 302.4, 229
See application file for complete search history.

(56) References Cited

U.S. PATENT DOCUMENTS

| | | | |
|---|---|---|---|
| 3,887,506 | A | 6/1975 | Hewitt |
| 3,908,388 | A | 9/1975 | DeVries |
| 4,124,982 | A | 11/1978 | Fuller |
| 4,277,203 | A | 7/1981 | Reed, Jr. et al. |
| 4,325,658 | A | 4/1982 | Baker |
| 4,592,931 | A | 6/1986 | Cargle |
| 4,799,549 | A | 1/1989 | Vinot et al. |
| 5,228,808 | A | 7/1993 | McKennon et al. |
| 5,336,022 | A | 8/1994 | McKennon et al. |
| 6,248,697 | B1 | 6/2001 | Goodhue, Jr. et al. |
| 6,695,545 | B2 | 2/2004 | Boston |
| 6,835,761 | B2 | 12/2004 | Harrison |
| 6,897,186 | B2 | 5/2005 | Goodhue, Jr. et al. |
| 7,651,294 | B2 | 1/2010 | Maier |
| 7,878,731 | B2 | 2/2011 | Maier |
| 7,922,810 | B2 | 4/2011 | Atoon |
| 8,070,979 | B2 | 12/2011 | Vitale et al. |
| 8,070,980 | B2 | 12/2011 | Vitale et al. |

*Primary Examiner* — Tara M. Pinnock
(74) *Attorney, Agent, or Firm* — McHale & Slavin, P.A.

(57) ABSTRACT

A method of inline mixing the exact amount of sodium silicate, catalyst and water to form a grout for injection into underground construction applications in order to eliminate waste of resources. The invention is comprised of a sodium silicate pump assembly and a water and catalyst pump assembly. A metering pump injects a catalyst into the water loop. The sodium silicate pump and the water and catalyst pump discharge lines are merged into one pipeline downstream. The single pipe is connected to a static inline mixer that ensures uniform mixing of all the components. The sodium silicate pump assembly and the water and catalyst pump assembly are hydraulically controlled. This allows an operator to vary the speed of the pump thereby controlling pump discharge.

6 Claims, 1 Drawing Sheet

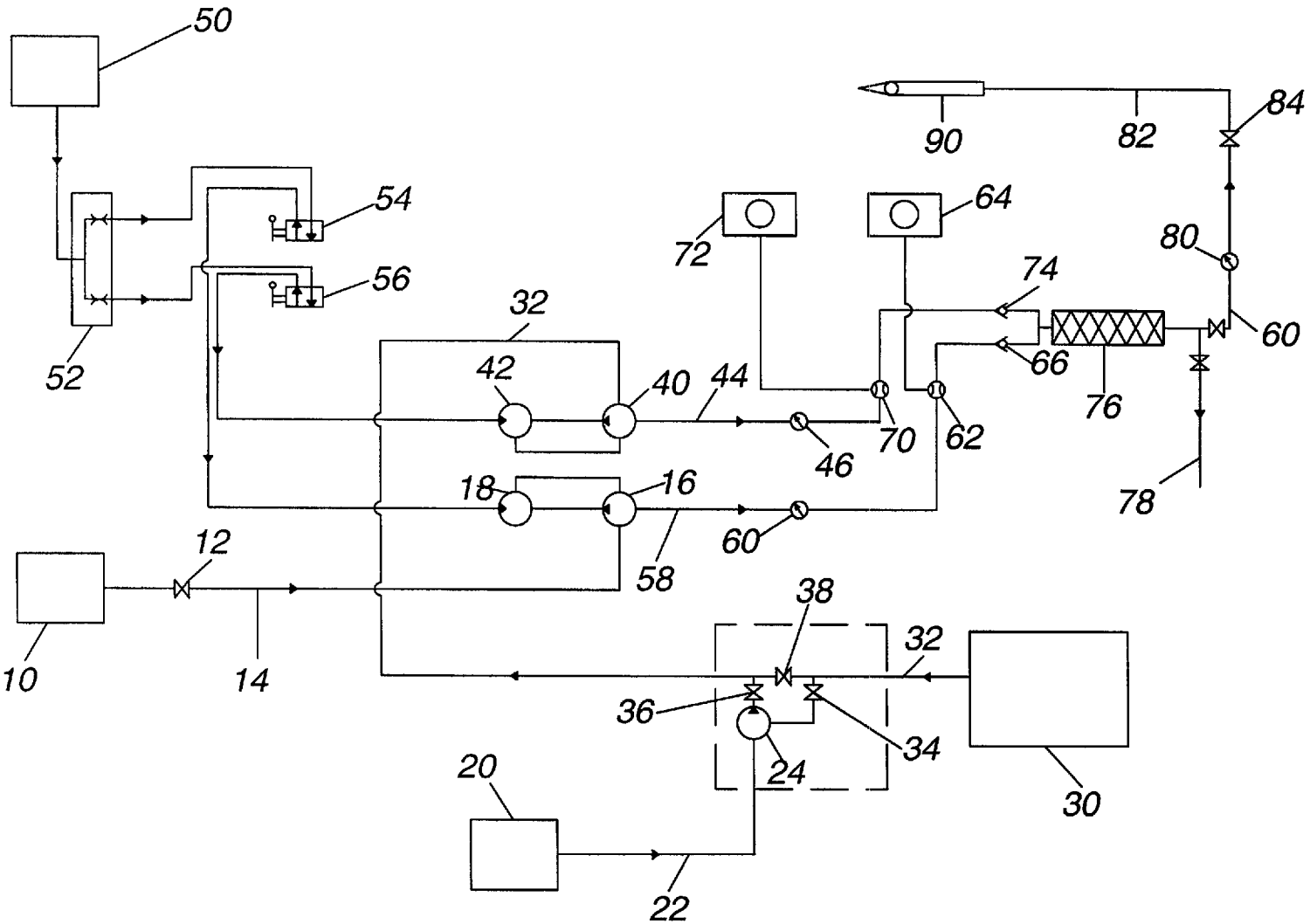
84
60
80
82
78
76
74
66
64
62
90
70
46
72
44
40
16
58
60
32
42
18
54
56
50
52
12
14
10
30
32
34
38
24
36
22
20

SOIL STABILIZATION METHOD AND APPARATUS

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 61/765,478, entitled "SOIL STABILIZATION METHOD AND APPARATUS", filed Feb. 15, 2013. The contents of which the above referenced application is incorporated herein by reference.

FIELD OF THE INVENTION

The present invention relates generally to soil stabilization and, more particularly, to a method and apparatus for metering sodium silicate, a catalyst and water for use soil stabilization.

BACKGROUND OF THE INVENTION

Sodium silicate based injection systems are used in a number of construction applications to create a stable foundation. For example, sodium silicate can be used to fill in the pores between the solid particle and the soil. This will displace as well as compact the soil in order to improve the load bearing characteristics of the soil.

Sodium silicate can also be used to mitigate settlement and collapse of dirt walls created during an excavation project. In many instances, sodium silicate grout can be injected underneath the foundation of a settling structure to prevent any further settlement.

Sodium silicate can only be utilized to seal a leak. For example, sodium silicate grout could be injected underneath a pump well casing that was leaking and/or beginning to sink. The injection of a proper amount of sodium silicate grout would stabilize the structure from additional sinking, seal any leak and fill the voids in the soil where water was seeping.

Sodium silicate and a catalyst are mixed together in water. The mixture will cure into a solid gel like substance after a period of time. This time period can vary based on factors such as heat and humidity. It is critical to have all of the mixture pumped into the ground before it cures to a solid and can no longer be pumped. If the mixture is sufficiently diluted with water, pumping will not be an issue; however the mixture will seep out of the void it was intended to fill and lose its effectiveness.

Conventional methods for preparing sodium silicate based grout is to batch mix all of the components. The ground injection pump will then suction from the batch mixing tank. When utilizing this method, any of the mixture that cures before being pumped becomes waste. This waste becomes extremely costly over time.

An example of an application of sodium silicate based grout injection is U.S. Pat. No. 6,897,186, which discloses an excavation fluid composition useful for enlarging a cavity in the earth includes a synthetic polymer and sodium silicate. The excavation fluid composition is formulated so as to enable the fluid in contact with unstable or sandy soils in the selected areas of the excavation to react and form silicate-based derivatives with lesser solubility, and movement and thus improve soil stability at the excavation wall. The grout in this application is batch mixed thereby creating waste of any grout that is not pumped before curing has occurred.

What is lacking in the art is a method for determining the proper proportion of soil stabilization material necessary for a particular soil and environmental conditions, and for the metering, inline mixing and pumping of a precise amount of materials necessary for optimum soil stabilization.

SUMMARY OF THE INVENTION

The instant invention provides a method of inline mixing a precise amount of sodium silicate, catalyst and water to form a grout for injection into underground construction applications based upon soil and environmental conditions. Aqueous sodium silicate is injected simultaneously with a catalyst and water mixture into a convergent piping system by use of pumps having hydraulic motors. The single pipe flow is routed through an in-line static mixer with the mixture discharge pressure monitored. The hydraulic motors allow for a direct adjustment of pump discharge volume and pressure.

It is an objective of the instant invention to disclose a soil stabilization method and apparatus that allows for precise mixing using variable speed pump assemblies with a means for monitoring ground stabilization.

It is yet another objective of the instant invention to disclose a method of controlling the amount of material being mixed by varying the speed of hydraulic motors and temporarily suspending halting the pumping operation without material curing within the pumping system.

It is still yet another objective of the present invention to provide a method of sampling for predicting the material curing rate.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE FIGURES

FIG. 1 is a flow schematic drawing of the present invention.

DETAILED DESCRIPTION OF THE INVENTION

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Illustrated is a schematic that depicts the method and apparatus of the instant invention. In particular, the method and apparatus allows for a precise amount of sodium silicate and catalyst to be admixed with water for use in soil stabilization. A sodium silicate tank 10 having a control valve 12 is coupled to sodium silicate pump assembly 16 by sodium silicate suction line 14. The sodium silicate pump assembly 16 is preferably a centrifugal pump. The sodium silicate pump 16 is powered by a hydraulic motor 18. The motor allows for the operator to vary the speed of the motor and control pump output. However other motors could be installed, such as but not limited to an electric motor with a variable frequency driver.

A catalyst tank 20 is coupled to a catalyst chemical pump 24 by suction line 22. The catalyst chemical pump 24 is a hydraulically operated variable proportioning mixing pump.

A water tank 30 is provided with feeder line 32 attached to the suction side of a water and catalyst pump 40. In a preferred embodiment, the water and catalyst pump 40 is a centrifugal pump. However, any suitable pump can be installed such as but not limited to gear pumps and vane pumps. Catalyst is fed into the water tank feeder line 32 through a bypass loop consisting of first valve 34 which feeds into the catalyst chemical pump 24. The water and catalyst mix is discharged into a line controllable by discharge valve 36 into the feeder line 32. A bypass valve 38 is installed in the water feeder line 38. By opening valve 38 and closing valves 34 and 36 the catalyst chemical pump can be isolated and the system flushed.

The water and catalyst pump 40 is powered by a hydraulic motor 42. This water and catalyst pump allows for the operator to vary the speed of the flow rate and control pump output. Other motors could be installed, such as but not limited to an electric motor with a variable frequency driver.

A hydraulic power unit 50 provides hydraulic fluid to the hydraulic motors. A hydraulic flow divider 52 is installed to direct the flow to each of the hydraulic motors 18 and 42. A first hydraulic control valve 54 operated the sodium silicate pump assembly 16 hydraulic motor 18. A second control valve 56 operates the water and catalyst pump 40 hydraulic motor 42.

For ease of on-site operation the hydraulic control valves are manually operated. Once the soil at the particular site is tested by use of a sampling port, the controls can be maintained throughout the process.

The sodium silicate pump 16 has a discharge line 58 with a pressure gauge 60 to monitor flow rate pressures. A flow meter 62 is also positioned in the discharge line 58 having a digital flow rate display 64. A check valve 66 prevents backflow into the system.

Similarly, the water and catalyst pump 40 has a discharge line with a pressure gauge 46 installed in the line for visual monitoring flow rate pressures. Flow meter 70 is installed in the discharge line and connected to a digital flow rate display 72. Check valve 74 prevents a backflow of the water and catalyst.

Discharge lines 44 and 58 are fluidly coupled to a static mixer 76 sized to intermix the fluids at the maximum flow rate expected from the pumps. The static mixer 76 is a pipe internally comprising of mixing elements such as blades and helix grids geometrically configured to facilitate radial mixing. The flow path is directed in a specific geometrical path in order to ensure that the entire flow is subjected to uniform mixing.

The discharge line 60 includes a bleed line 24 for sampling and monitoring. A pressure gauge 80 provides a final pressure check and is constructed and arranged to cooperate with attachment of a substantially flexible hose 82 after shutoff valve 84. The flexible hose has a fitting 86 constructed and arranged for attachment to a ground injection pumping device.

The disclosed invention is intended to be portable. Therefore an enclosed trailer of a suitable size, capable of being attached to a vehicle, is used to house all of the components of the invention. However, it is contemplated that another vehicle such as a box truck could be utilized to transport the equipment.

Once grout injection is called for, sodium silicate is pumped into the system through the sodium silicate pump 16. In a preferred embodiment, the aqueous sodium silicate comprises 50% of the mixture. However, a higher or lower concentration of the sodium silicate could be used without deviating from the scope of the invention. The sodium silicate pump discharge is monitored using the digital flow meter 64 at a predetermined rate. Simultaneously, water flows into the system through the catalyst pump. The catalyst and water are mixed in the catalyst pump. In a preferred embodiment, the catalyst is Diacetin, a food grade acid with the chemical symbol $CH_3COOCH_2CH(OH)CH_2OCOCH_3$. The catalyst is mixed at a ratio of between 5-20% of the volume of the water. The catalyst and water mixture is then pumped through the water and catalyst pump 1. The water and catalyst pump 1 discharge corresponds with the predetermined discharge rate of the sodium silicate pump 16 using the digital flow rate display 72.

The discharge pressure is monitored at the pressure gauge 80 downstream of the static mixer. In a preferred embodiment, the discharge pressure is maintained in a range from 25 psi to 45 psi. The discharge pressures are maintained by varying the flow of hydraulic fluid to the hydraulic motors 18 and 42.

The sodium silicate, catalyst, and water are mixed as a function of the discharge volume rate pumping into the ground. The volume of each pump output is determined by factors such as the rate of cure of the mixture as well as the size of the underground space to be filled. The rate that the sodium silicate mixture will cure is dependent on many variables. These factors include but are not limited to, moisture, temperature, position and depth of the void to be filled. A predetermined amount of discharge is collected through the bleed line in order to determine the rate of cure.

Injection pumping device 90 is inserted into the ground and pumping of the mixture is conducted in stages. The initial pumping is done at the maximum depth of the void. The injection pumping device is then retracted systematically to pump at different levels in the soil. Generally, 5 gallons of mixture is pumped per foot of lift. The pumping is terminated at each level when a predetermined discharge pressure threshold is exceeded indicating that the intended space has been filled. All of the steps are repeated until the required amount of sodium silicate based grout is pumped into the ground.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A method for soil stabilization comprising the steps of:

providing a sodium silicate tank within a mobile trailer, said sodium silicate tank fluidly coupled to a hydraulic motor operated sodium silicate pump assembly for injecting a calculated amount of sodium silicate through said sodium silicate pump;

providing a catalyst tank within said mobile trailer, said catalyst tank fluidly coupled to a catalyst chemical hydraulically operated variable proportioning mixing pump for injecting a calculated amount of catalyst;

providing a water tank fluidly within said mobile trailer, said water tank coupled to said catalyst chemical pump for admixing a predetermined amount of water with said injected catalyst, said admixture directed to a hydraulic motor operated water/catalyst pump;

controlling each said hydraulic motor by a manual operated hydraulic control valve;

monitoring sodium silicate pump discharge pressure and flow rate and adjusting said sodium silicate pump to meet a predetermined pressure and flow rate;

monitoring water/catalyst pump discharge pressure and flow rate and adjusting said water/catalyst pump to meet a predetermined pressure and flow rate;

coupling discharge lines from said water/catalyst and said sodium silicate to a static mixer as a function of a discharge volume rate;

distributing the mixed admixture passed from said static through a flexible hose to a soil site, maintaining a predetermined discharge pressure through said flexible hose by varying flow of hydraulic fluid to said hydraulic motors;

bleeding an amount of the mixed admixture through a bleed line and monitoring the time the mixed admixture requires to cure into a solid and adjusting said pumps accordingly; and terminating pumping when a predetermined discharge pressure is reached based upon a calculated curing time obtained from said bleeding step.

2. The method for soil stabilization according to claim 1 wherein the sodium silicate tank contains $CH_3COOCH_2CH(OH)CH_2OCOCH_3$.

3. The method for soil stabilization according to claim 1 wherein the catalyst is mixed at a ratio of between 5-20% of the volume of the water.

4. The method for soil stabilization according to claim 1 wherein said predetermine discharge pressure is between 25 psi and 45 psi.

5. The method for soil stabilization according to claim 1 wherein distributing the mixed admixture is performed in stages with an initial stage pumping performed at the maximum depth of a void and pumping retracted systematically to pump at different levels in the soil in an amount of about 5 gallons of mixture per foot of lift.

6. The method for soil stabilization according to claim 5 wherein pumping is terminate at each stage when a predetermined discharge pressure threshold is exceed which indicates the void has been filled.

* * * * *